United States Patent [19]

Zorinsky et al.

[11] Patent Number: 4,891,103

[45] Date of Patent: Jan. 2, 1990

[54] ANADIZATION SYSTEM WITH REMOTE VOLTAGE SENSING AND ACTIVE FEEDBACK CONTROL CAPABILITIES

[75] Inventors: Eldon J. Zorinsky; David B. Spratt, both of Plano, Tex.

[73] Assignee: Texas Instruments Incorporated, Dallas, Tex.

[21] Appl. No.: 235,130

[22] Filed: Aug. 23, 1988

[51] Int. Cl.[4] ..... C25D 11/32/21/12

[52] U.S. Cl. ..... 204/1 T; 204/345; 204/56.1; 204/129.25; 204/129.3; 204/228; 204/237; 204/129.75; 204/252; 204/266; 204/406

[58] Field of Search ..... 204/1 T, 129.3, 129.1, 204/34.5, 56.1, 228, 252, 256, 258, 278, 273, 277, 129.75, 231, 263–266, 406, 129.25

[56] References Cited

U.S. PATENT DOCUMENTS

| | | | |
|---|---|---|---|
| 2,686,279 | 8/1954 | Barton | 204/56.1 X |
| 3,010,885 | 11/1961 | Schink | 204/56.1 X |
| 3,634,213 | 1/1972 | Coates | 204/56.1 |
| 3,798,139 | 3/1974 | Schwartz | 204/56.1 |
| 4,133,724 | 1/1979 | Hartnagel et al. | 204/56.1 X |
| 4,166,782 | 9/1979 | Collins et al. | 204/129.3 |
| 4,628,591 | 12/1986 | Zorinsky et al. | 204/129.1 X |

*Primary Examiner*—Donald R. Valentine

*Attorney, Agent, or Firm*—George L. Craig; Thomas W. DeMond; Melvin Sharp

[57] ABSTRACT

The disclosure relates to a process station to precisely control the electrochemical anodization of specially prepared silicon substrates. Remotely placed voltage probes are utilized to monitor changes in the potential drop across the wafer as the anodization proceeds. As the available anodilizable area changes, the voltage drop across the wafer and hence the anodization current density is maintained at the desired value by the computer through the use of active feedback provided by these probes. Any desired anodization conditions can be programmed into the system using the system software, thereby adding an even greater degree of control over the process.

16 Claims, 2 Drawing Sheets

ANADIZATION SYSTEM WITH REMOTE VOLTAGE SENSING AND ACTIVE FEEDBACK CONTROL CAPABILITIES

BACKGROUND OF THE INVENTION

1. Field of the Invention

This invention relates to a system for electrochemical anodization of silicon substrates and, more specifically, to computer controlled anodization of specially prepared porous silicon substrates.

2. Brief Description of the Prior Art

Anodization of bulk silicon generally takes place in order to create silicon having a density which is about half that of the bulk silicon due to the formation of pores in the anodized region. This pore formation provides an increase in surface area of the anodized silicon and permits the anodized region to be oxidized more rapidly than the bulk silicon. Anodization is often used to form isolated islands of silicon within the wafer bulk. An example of the formation of such islands involves starting with N− bulk silicon, forming an N+ layer thereon followed by an N− layer. The isolated island regions are then masked with a layer of silicon nitride followed by a layer of silicon oxide and the unmasked regions are then etched to a level into the bulk to provide a trench exposing the N+ layer. Anodization now forms pores in the N+ layer and subsequent oxidation causes formation of an oxide layer in the region of the former N+ layer as well as along the sidewalls of the trench.

In the prior art of anodization of silicon substrates, it has been necessary to make direct ohmic contact to the substrate being anodized via some metallizing scheme in order to monitor and control the voltage drop thereacross during anodization. Such monitoring is necessary in order to avoid deleterious effects in anodization of the substrate due to changes in the voltage drop across the wafer and, hence, the anodization current density as well as changes due to anodizable area changes. Constant current density is critical to the uniformity of the anodization process and to the subsequent oxidation process since non-uniformities in current density during the anodization process lead to variations in the sizes of the resulting pores in the porous layer, particularly for features 30 microns wide or less. Variable pore size, in turn, leads to oxidation induced stresses which cause unacceptable defect levels in the isolated islands formed. In addition, changes in electrolyte concentration which occur with depletion of the electrolyte can result in electrochemical etching as opposed to anodization. Such prior art related to anodization and methods thereof are set forth in U.S. Pat. No. 4,628,591 and pending application Ser. No. 806,258, filed Dec. 6, 1985 of Zorinsky et al., now abandoned, and Ser. No. 810,001, filed Dec. 17, 1987 of Keen et al., now abandoned, and all assigned to the assignee of the subject application, as well as in the literature referenced in these applications and patent wherein direct contact with the wafer or substrate in some fashion is described. It has been found by the present invention that the problems inherent in systems making direct ohmic contact to the wafer being anodized are lessened by providing a system wherein such direct contact is not required.

SUMMARY OF THE INVENTION

Briefly, in accordance with the present invention, the above noted problems of the prior art are minimized and there is provided anodization with substantially uniform porosity throughout the anodized region by a system which precisely controls the electrochemical anodization of specially prepared silicon substrates, wherein regions to be anodized are more highly doped and surround a less doped island therein on which a circuit device is to be fabricated. The invention utilizes remotely placed voltage probes to monitor changes in the potential drop across the wafer as the anodization process proceeds. As the available anodizable area changes, the voltage drop across the wafer and hence the anodization current density is maintained at the desired value by the computer through the use of active feedback provided by these probes. By eliminating the need for voltage control via direct ohmic contact to the wafer, this system makes it possible to design a production process station suitable for use in a front end manufacturing environment. Furthermore, any desired anodization conditions can be programmed into the system using the system software, thereby adding an even greater degree of control over the process. In some cases, it may be necessary to anodize many tens of microns laterally. This system provides the capability to vary the slice potential in a controlled fashion so as to compensate for any electrolyte depletion that occurs. Such depletion adversely impacts the final pore size, causing possible electrochemical etching rather than anodization. Slight modifications to the current density in these situations is highly desirable.

Basically, the anodization system of the present invention includes a closed loop comprising a data aquisition unit, a power supply, an optional current and/or voltage measuring meter between the power supply, data acquisition unit and an anodization tank, and the anodization tank with electrolyte and device to be anodized, such as a semiconductor wafer, in the electrolyte, the device separating the tank into two chambers. A pair of probes is disposed in the electrolyte, one probe on each side of the device, the probes being spaced from the device to measure the voltage drop across the device to provide signals to the data acquisition unit external of the tank indicative thereof. Also disposed within the tank is a pair of electrodes of standard type which is coupled to the data acquisition unit and provides a controlled voltage or current across the tank.

The data acquisition unit provides signals to and receives signals from a computer and controls operation within the loop based upon the signals received from the computer. The computer has a memory and drives a plotter or other display device. The computer is not a part of the loop and is preferably the only element of the system which is software controlled, all other system components being essentially hardward elements. The computer controls system operation via the data acquisition unit.

The power supply provides controlled voltage and/or current across the anodizing tank under control of the data acquisition unit and provides data back to the data acquisition unit to indicate the voltage and/or current being supplied across the tank. An ammeter is optionally located in the path from the power supply to the anodization tank as well as from the power supply to the data acquisition unit to provide an immediate reading of voltage and/or current being supplied to the tank.

The computer is programmed to provide any desired voltage drop across the wafer and/or current there-through. The anodization characteristics, i.e., the porosity, the rate and the selectivity are determined by the voltage and current applied to the interface at the front of the slice and also to the acid concentration of the electrolyte to a lesser extent.

The characteristics of the anodization process change because of changes in anodizable area and acid concentration deep into the pores being created in the material. It is therefore desirable to change the voltage and/or current as the process proceeds to compensate for these changes.

The system has a real time feedback loop wherein, as the area of the wafer available for anodization changes, the current density can be controlled by controlling the voltage through the feedback loop. The anodization process is self-limiting. Uniform porosity is important because, if there is a porosity gradient within the porous layer, a great deal of stress is induced after oxidation of the material. It is this stress which provides the defects in the isolated material which is fatal to the production of bipolar devices and detrimental to the production of MOS devices.

In operation, a wafer which has been processed to include a trench with an N+ layer therein exposed at a surface of the wafer and which is to be anodized is placed in an anodizing tank filled with appropriate electrolyte, preferably hydrofluoric acid (HF) electrolyte in the range of 10 to 40% and preferably 20%. Other electrolytes which can be used are combinations of hydrofluoric acid and materials which will better wet the surface and reduce the surface tension so that bubble formation is not as much of a problem, the wafer performing an electrical and physical separation between the two half cells of the tank to form two chambers. A predetermined voltage is initially provided across the tank electrodes, this voltage being determined by the voltage programmed across the wafer at that time by the computer, via the data acquisition unit. The electrolyte causes pores to form at the surface of the N+ layer and gradually work their way deeper into the silicon layer and forms new pores. This process continues for the duration of the anodizing period. The silicon removed from the pore region goes into solution in the electrolyte. As the pores form, the voltage across the probes changes due to the changes in anodizable area. As the anodization proceeds, the acid deep in the pores may become depleted, thereby changing the effective electrolyte concentration. This, in turn, may cause a change in porosity. It is therefore necessary to modulate the voltage across the wafer to compensate for these changes in order to insure the formation of uniformly porous material under all device islands. It is also desirable to lower the voltage substantially near the end of the anodization cycle to provide for minimum surface continuity at the interface with the anodized region.

A data base of porosity as a function of acid concentration and current density, the lateral anodization rate at each current density and each acid concentration is used to determine the appropriate program parameters for each device type. The changes in voltage programmed across the anodizing tank are based upon the data base and the desired rates originally programmed into the system. The data base is empirical in nature.

drawing A shows the wiring and external connections of the ammeter 5 and power supply 3;

drawing B shows the external connections of the data acquisition unit 1; and drawings C and D show the wiring of the plugs of drawing B.

DESCRIPTION OF THE PREFERRED EMBODIMENT

Figure 1:
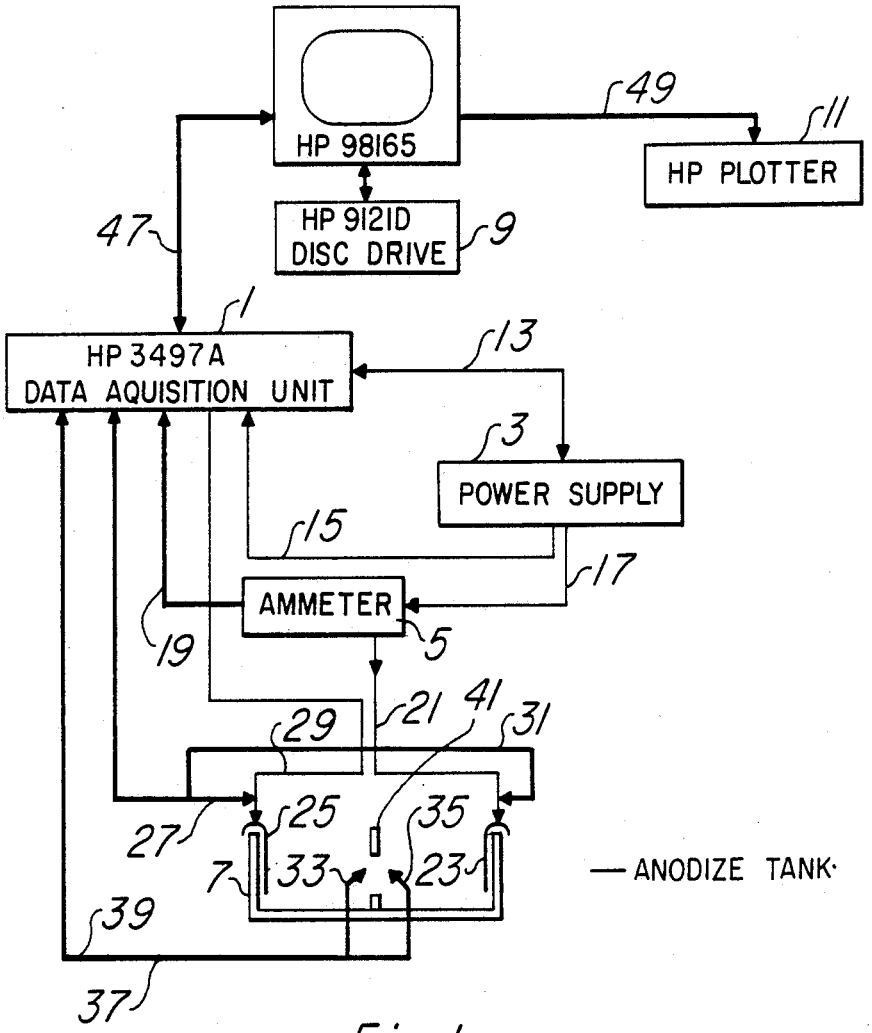
FIG. 1 is a block diagram of the system configuration of an anodization system in accordance with the present invention.

Referring first to FIG. 1, there is shown a block diagram of the anodization system in accordance with the present invention. The system comprises a closed loop control including a data acquisition system 1, which is preferably a Hewlett-Packard Model HP 3497A and which is coupled to a power supply 3 via a two way lead 13 as well as a lead 15 coupled back to the acquisition unit 1. The power supply is also coupled to an optional ammeter 5 via conductor 17, the ammeter being coupled to the data acquisition unit 1 via conductor 19 and providing the power to the positive platinum electrode 23 in the anodizing tank 7 via the conductor 21. The negative electrode 25 in the anodizing tank 7 is coupled to the data acquisition unit 1 via reference voltage lead 27 and lead 29 whereas the positive electrode 23 is coupled to the data acquisition unit 1 via the lead 31. Probes 33 an 35 are disposed in opposite portions of the tank 7 and are connected to the data acquisition unit 1 via leads 37 and 39. A semiconductor wafer 41 is positioned in the tank 7 and separates the electrolyte in the tank into two separate chambers as will be explained in more detail hereinbelow. Probes 33 and 35 are on opposite sides of the wafer 41 and measure the voltage across the opposite sides of wafer 41. That voltage measurement provides data that is used to control the anodization process.

The data acquisition unit is driven by a computer 43, preferably a Hewlett Packard Model MP 98165 which operates in accordance with the program set forth in Appendix A herein which is preferably stored in the disk drive 9, preferably a Hewlett Packard Model HP 9121D, which sends data to and receives data from the data acquisition unit 1 along the line 47. Also shown in FIG. 1 is a display device in the form of a plotter 11 coupled to the computer 45 via the conductor 49.

Figure 2:
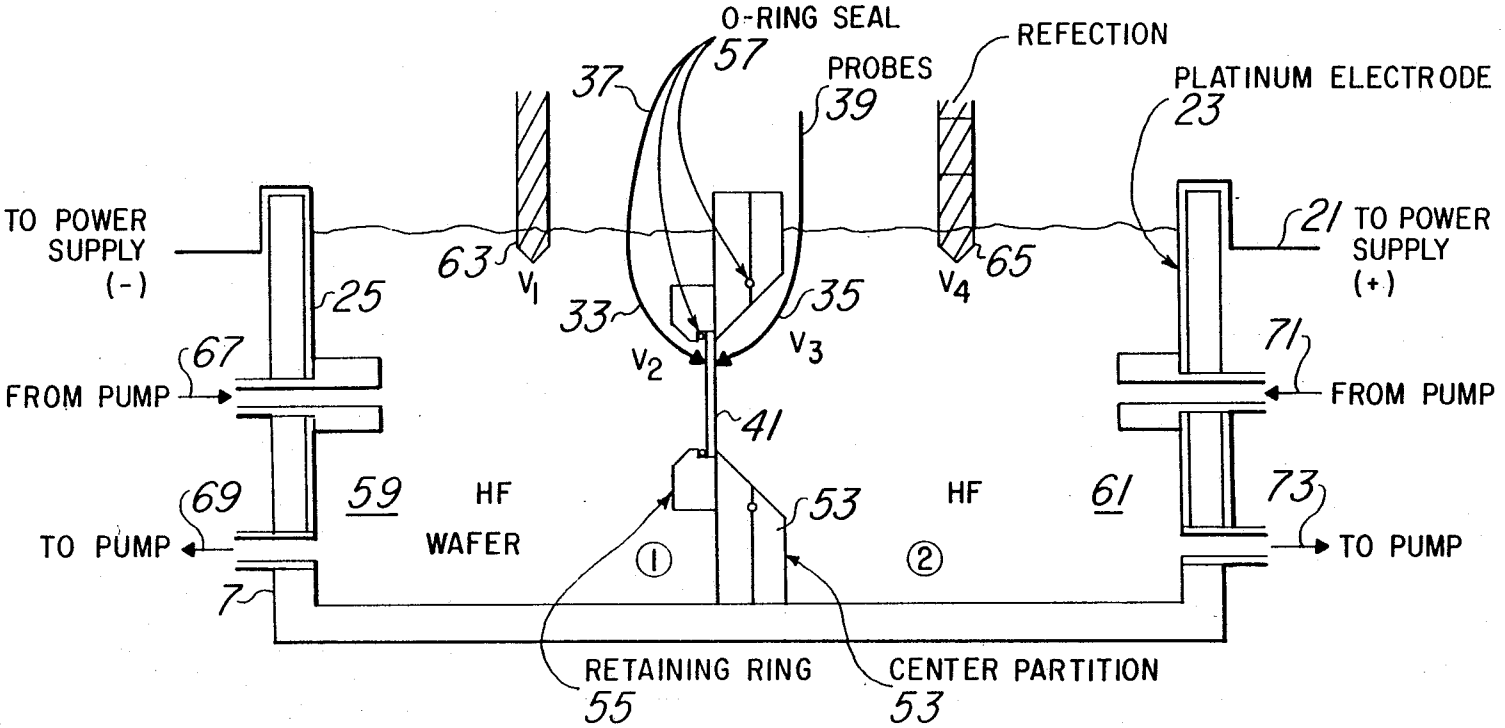
FIG. 2 is an enlarged detailed schematic diagram of of the anodization tank of FIG. 1.

Referring now to FIG. 2, there is shown an enlarged and more detailed cross section of the anodization tank 7 of FIG. 1. The tank includes center partitions 53 and 55 and retaining rings 54 and 56, the partitions and retaining rings each having retaining means including O-rings 57 for sealingly securing the wafer 41 thereto to isolate electrolyte in tank chamber 59 from electrolyte in tank chamber 61. A reference electrode 63 having a voltage V1 is positioned in the electrolyte in chamber 59 and a reference electrode 65 having a voltage V4 is positioned in the electrolyte in chamber 61. Electrolyte in chamber 59 is recirculated into and out from that chamber by a first pump (not shown) via inlet 67 and outlet 69 whereas electrolyte in chamber 61 is recirculated into and out from that chamber by a second pump (not shown) via inlet 71 and outlet 73.

In operation, the tank 7 is filled with electrolyte to a level above the top of the wafer 41 and the wafer is secured by retaining ring 55 and center partition 53 in the tank to form the separate and isolated chambers 59 and 61. The computer 45 is then controlled externally to provide the required data as set forth in the program in Appendix A to provide the required current and voltage in the tank 7 via the electrodes 23 and 25 until complete anodization takes place. Anodization then takes place either by timing the process to completion using the rate thereof at a given current density along with the width of the largest feature requiring isolation or, by using a minimum current value (i.e., when all features have anodized, only regions in the field continue to anodize, resulting in constant (small) current. At the completion of anodization, the system will turn off and the wafer 41 is removed from the tank 7. The procedure is then repeated for the next wafer 41.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

APPENDIX A

The following is a program for use in the Hewlett Packard HP 98165 computer in conjunction with the present invention:

```
1 DISP "STARTING PROGRAM"
10 DIM A(2000),B(9,5)
11 COM Er
13 Calib1=0
20 ON KEY 0 LABEL "ABORT" GOTO 30
21 ON KEY 8 LABEL "GCLEAR" CALL G
30 OUTPUT 709;"A04,0.0 A04,1,0"
32 WAIT .5
33 CLEAR 709
34 ALPHA ON
50 DISP "INPUT PASSWORD  ";
60 INPUT Ans$
70 IF Ans$<>"THUNDER" THEN GOTO 50
80 IF Calib1=0 THEN 5000
100 DISP "DO YOU WANT TO RUN(1),PLOT(2),PRINT(3),OR DEFINE(4)?";
110 INPUT Ans
120 ON Ans GOTO 1000,2000,3000,4000,5000
1000 REM **** BEGINNING OF RUN ROUTINE  ***
1010 DISP "WHAT IS LOT NO?";
1020 INPUT Lot$
1021 DISP "WHAT IS SLICE NO?";
1022 INPUT Sl$
1025 Fil$="L"&Lot$&"S"&Sl$
1030 ON ERROR GOTO 1050
1040 CREATE BDAT Fil$&":HP8290X,700,1",1000,40
1041 GOTO 1240
1050 IF ERRN=54 THEN 1060
1051 GOTO 1210
1060 DISP "DATA FOR ";Lot$;" SL ";Sl$;" ALREADY EXISTS!";
1070 DISP " DO YOU WANT TO REPLACE(1), TRY AGAIN(2), OR BACK(3)?";
1080 INPUT Ans
1090 ON Ans GOTO 1240,1010,100
1210 IF ERRN=64 THEN 1220
1211 GOTO 1230
1220 DISP "NOT ENOUGH ROOM ON THE DISK";
1221 GOTO 1010
1230 DISP "ERROR IN CREATE";
1231 OFF ERROR
1232 GOTO 100
1240 DISP "WHAT IS ACID CONC?";
1241 INPUT Hf$
1250 DISP "HOW MANY SEC PRE-ETCH TIME?";
1251 INPUT Pre
1260 DISP "WHAT PROGRAM FILE?";
1261 INPUT Pgm$
1270 ASSIGN @Fil TO Fil$&":HP8290X,700,1"
1321 OFF ERROR
1330 ASSIGN @Pgm TO Pgm$&":HP8290X,700,0"
1340 ENTER @Pgm,1;Dat$,R
1350 FOR I=2 TO R+1
1360 ENTER @Pgm,I;B(I-2,0),B(I-2,1),B(I-2,2),B(I-2,3),B(I-2,4),B(I-2,5)
1370 NEXT I
1380 GRAPHICS ON
1385 DISP "GRAPH SET-UP WILL FOLLOW! ";
1386 PLOTTER IS 3,"INTERNAL"
```

```
1387 GINIT
1390 VIEWPORT 0,130,25,100
1391 Ymax=5
1392 DISP "Y-AXIS IS 0 TO ";Ymax;" DO YOU WANT TO CHANGE(Y/N)?";
1393 INPUT Ans$
1394 IF Ans$<>"Y" THEN 1400
1395 DISP "INPUT YMAX:";
1396 INPUT Ymax
1400 WINDOW -20,230,-.2*Ymax,Ymax
1410 FRAME
1420 CLIP 0,230,0,Ymax
1430 AXES 2,.02*Ymax,0,0,5,5,2
1432 GRID 10,.1*Ymax,0,0
1435 CLIP -20,230,-.2*Ymax,Ymax
1436 CSIZE 4
1440 FOR I=0 TO Ymax STEP Ymax/5
1450 MOVE -10,I-(.03*Ymax)
1451 LABEL I
1460 NEXT I
1470 FOR I=0 TO 230 STEP 30
1480 MOVE I-10,-.10*Ymax
1481 LABEL I
1490 NEXT I
1500 MOVE 50,-.15*Ymax
1501 LABEL "ELAPSED TIME-SECONDS"
1502 MOVE -10,-.2*Ymax
1503 LABEL "PS-V  PS-I  TIME  TANK-V  PROBE-V  TANK-I"
1510 DEG
1511 LDIR 90
1520 MOVE -8,.2*Ymax
1521 LABEL "CURRENT-AMPERES"
1540 DISP "LOAD SLICE AND TURN ON PUMP!-PRESS ENTER WHEN READY";
1550 INPUT Ans$
1560 OUTPUT 709;"TE0 TE2 DC2,0 " !  TURN ON PUMP,ZERO $ STRT PUMP
1570 DISP "PRE-ETCH CYCLE STARTED"
1580 OUTPUT 709;"TE"
1581 ENTER 709;Et
1590 IF Et>Pre THEN 1600
1591 GOTO 1580
1600 GRAPHICS ON
1601 DISP "ANODIZE CYCLE STARTED"
1603 ON KEY 6 LABEL "SKP REG" CALL Skip
1604 ON KEY 9 LABEL "CAPTURE" GOTO 1950
1610 OUTPUT 709;"AF0 AL3 VT4 VN3 VA0 VD4 AE1 AC3 AV0"
1611 OUTPUT 709;"A04,0,0 A04,1,0 TE0 TE2 DC2,1,2,3,4"
1620 Vps=1000*B(0,1)*Calib1+Offset1
1621 Ips=1000*B(0,3)*Calib2+Offset2
1622 Tmax=B(0,4)
1623 Tx=B(0,5)
1624 Elast=0
1626 Flag=0
1627 J=0
1628 L=0
1629 I=0
1630 Flag1=0
1631 IF Tx>0 THEN 1640
1632 Flag=1
1633 Flag1=1
1634 Vx=B(0,1)
1640 OUTPUT 709;"A04,0,";Vps;"A04,1,";Ips;"TE AC3"
1641 DISP Vps,Ips,Et,A(I+1),A(I),A(I+2)
1643 ENTER 709;Et
1651 TRIGGER 709
1660 ENTER 709;A(I),A(I+1),A(I+2)
1664 A(I+3)=Et
1670 IF Et>Tmax THEN J=J+1
1680 IF J>R-1 THEN 1740
1686 IF Flag=1 THEN 1959
1687 IF Et>=Tx THEN GOTO 1950
1694 Vps=1000*(B(J,0)*Et+B(J,1))*Calib1+Offset1
1700 Ips=1000*(B(J,2)*Et+B(J,3))*Calib2+Offset2
1701 Vps=INT(Vps)
1702 Ips=INT(Ips)
1710 Tmax=B(J,4)
1711 IF Et<=Elast THEN GOTO 1724
```

```
1712 Elast=Et
1720 PLOT Et,A(I+2),-1
1721 I=I+4
1722 L=L+1
1724 WAIT .5
1730 GOTO 1640
1740 !
1750 OUTPUT 709;"A04,0,0 A04,1,0 D02,0"
1760 FOR I=1 TO 500 STEP 1
1770 NEXT I
1780 OUTPUT 709;"D02,1,2,3,4"
1781 OFF KEY 6
1783 OFF KEY 9
1790 ALPHA ON
1800 DISP "ANODIZE COMPLETE-REMOVE SLICE  ";
1801 BEEP
1802 OUTPUT 709;"BEEP BEEP BEEP BEEP BEEP"
1810 DISP "WANT TO SAVE DATA(Y/N)?";
1811 INPUT Ans$
1812 GRAPHICS OFF
1813 ALPHA ON
1820 IF Ans$="N" THEN 1822
1821 GOTO 1872
1822 ASSIGN @Fil TO *
1825 PURGE Fil$&":HP8290X,700,1"
1830 DISP "NEW SLICE(Y/N)?";
1831 INPUT Ans$
1840 IF Ans$="Y" THEN 1850
1841 GOTO 100
1850 DISP "WHAT IS SLICE NO?";
1851 INPUT S1$
1860 GOTO 1025
1872 ASSIGN @Fil TO *
1873 PURGE Fil$&":HP8290X,700,1"
1874 CREATE BDAT Fil$&":HP8290X,700,1",L+3,40
1875 ASSIGN @Fil TO Fil$&":HP8290X,700,1"
1879 OUTPUT @Fil,1;Pre,L,Pgm$
1880 OUTPUT @Fil,2;Dat$,Hf$
1882 I=0
1883 FOR J=3 TO L+3
1890 OUTPUT @Fil,J;A(I),A(I+1),A(I+2),A(I+3)
1891 I=I+4
1900 NEXT J
1910 ASSIGN @Fil TO *
1920 GOTO 1830
1950 Sum=0.                    !KEY 9 DESTINATION
1951 FOR Z=1 TO 3 STEP 1
1952 OUTPUT 709;"AC3 VT3"
1953 ENTER 709;Vs,Vt,Ic
1954 Sum=Sum+Vs
1955 NEXT Z
1956 Vx=Sum/3
1957 Tx=Et
1958 Flag=1
1959 IF Flag1=1 THEN Vx=B(J,0)*Et+B(J,1)
1960 Vps=(Vps-1000*(A(I)-Vx)/2)
1961 GOTO 1700
2000 REM **** PLOT ROUTINE ****
2010 PLOTTER IS 705,"HPGL"
2011 Xmin=0
2012 Xmax=120
2013 Ymin=0
2014 Ymax=5
2020 DISP "PLOT AXIS(1),PROGRAM(2),SLICE(3) DATA, HEADING(4),I-VDATA(5).OR QUIT(
6)?";
2030 INPUT Ans
2040 ON Ans GOTO 2130,2050,2450,2580,2700,100
2041 GOTO 2020
2050 DISP "WHAT IS PGM NAME?";
2051 INPUT Pgm$
2052 ON ERROR GOTO 2070
2060 ASSIGN @Pgm TO Pgm$&":HP8290X,700,0"
2061 GOTO 2090
2070 IF ERRN=54 THEN 2080
2071 DISP "FILE ERROR";
```

```
2072 GOTO 2020
2080 DISP "FILE NOT FOUND";
2082 GOTO 2020
2090 ENTER @Pgm,1;Dat$,R
2091 FOR I=1 TO R STEP 1
2092 ENTER @Pgm,I+1;B(I-1,0),B(I-1,1),B(I-1,2),B(I-1,3),B(I-1,4),B(I-1,5)
2093 NEXT I
2094 GOTO 2296
2130 PRINT "XMIN = ";Xmin;"  XMAX = ";Xmax;"  YMIN = ";Ymin;"  YMAX = ";Ymax
2140 DISP "DO YOU WANT TO CHANGE LIMITS(Y/N)?";
2150 INPUT Ans$
2160 IF Ans$="Y" THEN 2162
2161 GOTO 2190
2162 DISP "XMIN,XMAX,YMIN,YMAX?";
2163 INPUT Xmin,Xmax,Ymin,Ymax
2190 VIEWPORT 0,100*RATIO,0,100
2200 PEN 1
2210 LINE TYPE 1
2220 FRAME
2241 WINDOW -(Xmax-Xmin)*.1,Xmax*1.1,-(Ymax-Ymin)*.1,Ymax*1.2
2242 CLIP 0,Xmax,0,Ymax
2250 FRAME
2260 PEN 2
2270 AXES (Xmax-Xmin)/120,(Ymax-Ymin)/100,0,0,5,5,3
2271 AXES -(Xmax-Xmin)/120,-(Ymax-Ymin)/100,Xmax,Ymax,5,5,3
2272 CLIP OFF
2273 PEN 1
2275 CSIZE 3
2276 DEG
2277 LDIR 0
2278 MOVE Xmax*.30,-Ymax*.08
2279 LABEL "ELAPSED TIME - seconds"
2280 LDIR 90
2281 MOVE -Xmax*.05,Ymax*.20
2282 LABEL "VOLTAGE(CURRENT) - volts(amps)"
2283 LDIR 0
2284 FOR I=Ymin TO Ymax STEP (Ymax-Ymin)/5
2285 MOVE -Xmax*.04,I-Ymax*.02
2286 LABEL I
2287 NEXT I                    STEP
2288 FOR I=Xmin TO Xmax ~~ST~~  :(Xmax-Xmin)/8
2289 MOVE I-(Xmax*.03),-Yma:*.04
2290 LABEL I
2291 NEXT I
2292 PENUP
2293 PEN 0
2295 GOTO 2020
2296 DISP "WOULD YOU LIKE TO PLOT VOLTAGE(1), CURRENT(2), OR SKIP(3)? <CHOOSE PE
N>";
2300 INPUT Ans
2310 ON Ans GOTO 2321,2390,2020
2320 GOTO 2020
2321 T=0
2322 MOVE 0,0
2330 FOR I=1 TO R STEP 1
2340 FOR T=T TO B(I-1,4) STEP 1
2350 V=B(I-1,0)*T+B(I-1,1)
2360 PLOT T,V,-1
2370 NEXT T
2380 NEXT I
2381 MOVE B(0,5),Ymax*.05
2382 LABEL "x"
2383 PENUP
2384 PEN 0
2386 GOTO 2296
2390 T=0
2391 MOVE 0,0
2392 FOR I=1 TO R STEP 1
2393 FOR T=T TO B(I-1,4) STEP 1
2394 Ic=B(I-1,2)*T+B(I-1,3)
2395 PLOT T,Ic,-1
2396 NEXT T
2397 NEXT I
2398 PENUP
```

```
2400 GOTO 2296
2450 DISP "WHAT LOT WOULD YOU LIKE TO PLOT?";
2460 INPUT Lot$
2470 DISP "WHAT SLICE?";
2480 INPUT S1$
2490 Fil$="L"&Lot$&"S"&S1$
2491 ON ERROR GOTO 2503
2500 ASSIGN @Fil TO Fil$&":HP8290X,700,1"
2501 GOTO 2520
2503 IF ERRN=56 THEN 2506
2504 DISP "FILE ERROR";
2505 GOTO 100
2506 PRINT "FILE NOT FOUND"
2507 GOTO 2020
2520 ENTER @Fil,1;Pre,L,Pgm$
2521 ENTER @Fil,2;Dat$,Hf$
2522 I=0
2530 FOR J=3 TO L+3 STEP 1
2540 ENTER @Fil,J;A(I),A(I+1),A(I+2),A(I+3)
2541 I=I+4
2550 NEXT J
2551 ASSIGN @Fil TO *
2553 DISP "PLOT V-SLICE(1), V-TANK(2), CURRENT(3), LABELS(4) OR QUIT(5)? <CHOOSE
 PEN>";
2554 INPUT Ans
2555 ON Ans GOTO 2556,2556,2556,2564,2020
2556 MOVE 0,0
2557 FOR I=0 TO L*4 STEP 4
2558 PLOT A(I+3),A(I+Ans-1)
2559 NEXT I
2560 PENUP
2561 PEN 0
2563 GOTO 2553
2564 REM ** PLOT SLICE ACID,DATE, ETC ***
2566 CSIZE 2
2568 MOVE Xmax*.75,Ymax*.95
2570 LABEL "DATE - "&Dat$
2571 MOVE Xmax*.75,Ymax*.9
2572 LABEL "% ACID - "&Hf$
2573 MOVE Xmax*.75,Ymax*.85
2574 LABEL "PROGRAM - "&Pgm$
2575 MOVE Xmax*.75,Ymax*.8
2576 LABEL "LOT "&Lot$&" SL "&S1$
2578 PEN 0
2579 GOTO 2553
2580 REM ***LABEL ***
2581 CSIZE 4
2582 DEG
2583 LDIR 0
2584 PEN 1
2585 MOVE (Xmax-Xmin)/2-(Xmax-Xmin)*.15,(Ymax-Ymin)*1.10
2586 LABEL "TEXAS INSTRUMENTS"
2590 MOVE (Xmax-Xmin)/2-(Xmax-Xmin)*.30,(Ymax-Ymin)*1.05
2600 LABEL "LIMITED OXIDIZED POROUS SILICON"
2601 PENUP
2602 PEN 0
2610 GOTO 2020
2700 REM****I-V PLOT ROUTINE*****
2705 Xmin=0
2706 Ymin=0
2707 Xmax=10
2708 Ymax=4000
2710 PRINT "XMIN=";Xmin;"XMAX=";Xmax;"YMIN=";Ymin;"YMAX=";Ymax
2711 DISP "DO YOU WANT TO CHANGE LIMITS(Y/N)?";
2712 INPUT Ans$
2713 IF Ans$="Y" THEN 2715
2714 GOTO 2730
2715 DISP "LINEAR(1) OR LOG(2)?";
2720 INPUT Ans
2721 ON Ans GOTO 2725,2767
2722 GOTO 2715
2725 DISP "INPUT XMIN,XMAX,YMIN,YMAX";
2726 INPUT Xmin,Xmax,Ymin,Ymax
2730 REM ****BORDER & LABLES***
```

```
2735 VIEWPORT 0,100*RATIO,0,100
2736 PEN 1
2737 LINE TYPE 1
2738 FRAME
2739 WINDOW -(Xmax-Xmin)*.1,Xmax*1.1,-(Ymax-Ymin)*.1,Ymax*1.2
2740 CLIP 0,Xmax,0,Ymax
2741 FRAME
2742 AXES (Xmax-Xmin)/120,(Ymax-Ymin)/100,0,0,5,5,2
2743 AXES -(Xmax-Xmin)/120,-(Ymax-Ymin)/100,Xmax,Ymax,5,5,2
2744 CLIP OFF
2745 CSIZE 3
2746 DEG
2747 LDIR 0
2748 MOVE Xmax*.30,-Ymax*.08
2749 LABEL "VOLTAGE - VOLTS"
2750 LDIR 90
2751 MOVE -Xmax*.05,Ymax*.20
2752 LABEL "CURRENT - MILLIAMPS"
2753 LDIR 0
2754 FOR I=Ymin TO Ymax STEP (Ymax-Ymin)/10
2755 MOVE -Xmax*.05,I
2756 LABEL I
2757 NEXT I
2758 FOR I=Xmin TO Xmax STEP (Xmax-Xmin)/8
2759 MOVE I,-Ymax*.04
2760 LABEL I
2761 NEXT I
2762 PENUP
2763 PEN 0
2764 GOTO 2860
2765 REM *****RESERVED FOR LOG SCALE SETUP***
2850 GOTO 2715
2855 REM *****PLOTING DATA LINEARLY*****
2860 DISP "WHAT DATA(LOT) DO YOU WANT TO PLOT?";
2861 INPUT Lot$
2862 ON ERROR GOTO 2864
2863 GOTO 2870
2864 DISP "ERROR NO.";ERRN
2865 GOTO 2860
2870 DISP "WHAT SLICE NO.?";
2871 INPUT Sl$
2872 Fil$="L"&Lot$&"S"&Sl$
2873 ASSIGN @Fil TO Fil$&":HP8290X,700,1"
2874 ENTER @Fil,1;Pre,L,Pgm$
2875 ENTER @Fil,2;Dat$,Hf$
2876 I=0
2877 FOR J=3 TO L+3 STEP 1
2878 ENTER @Fil,J;A(I),A(I+1),A(I+2),A(I+3)
2879 I=I+4
2880 NEXT J
2881 OFF ERROR
2885 DISP "CHOOSE PEN COLOR.<CR>";
2886 INPUT Ans$
2890 MOVE 0,0
2891 I=0
2892 FOR J=3 TO L+3 STEP 1
2893 PLOT A(I+1),A(I+2),-1
2894 I=I+4
2895 NEXT J
2896 PENUP
2897 PEN 0
2898 REM **CHANGE 2893 IF DIFFERENT PARAMETERS ARE PLOTTED **
2900 DISP "PLOT ANOTHER LOT(Y/N)?";
2901 INPUT Ans$
2902 IF Ans$="Y" THEN 2860
2904 GOTO 2020
3000 REM***PRINT OUTPUT ROUTINE***
3010 DISP "PRINT ON SCREEN(Y/N)?"
3020 INPUT Ans$
3021 PRINTER IS 1
3030 IF Ans$="N" THEN CALL Prt
3031 DISP "WHAT LOT NO?";
3032 INPUT Lot$
3033 DISP "WHAT SLICE?";
```

```
3034 INPUT S1$
3035 Fil$="L"&Lot$&"S"&S1$
3039 DISP "PLACE PROPER DISK IN SLOT 2 - <CR>";
3040 INPUT Ans$
3041 ON ERROR GOTO 3046
3042 Er=1
                                  :HP8290X
3044 ASSIGN @Fil TO Fil$&"~~:HP8290X~~,700,1"
3045 GOTO 3049
3046 CALL Err1
3048 ON Er GOTO 3049,100,100,100,100
3049 OFF ERROR
3050 ENTER @Fil,1;Pre,L,Pgm$
3051 ENTER @Fil,2;Dat$,Hf$
3052 PRINT "CREATED ";Dat$
3053 PRINT "HF CONC - ";Hf$
3054 PRINT "PRE ETCH TIME - ";Pre
3055 PRINT "PROGRAM NO - ";Pgm$
3056 PRINT "ELASPED TIME      V-SLICE      V-TANK       CURRENT"
3057 K=0
3058 FOR J=3 TO L+3
3060 ENTER @Fil,J;Aa,Bb,Cc,Dd
3070 PRINT TAB(5);Dd;TAB(20);Aa;TAB(35);Bb;TAB(50);Cc
3071 K=K+1
3072 IF K<19 THEN GOTO 3080
3073 K=0
3074 DISP "<CR>"
~~3075 INPUT Ans$~~
3080 NEXT J
3081 ASSIGN @Fil TO *
3090 GOTO 100
4000 REM
4010 DISP "INPUT PROGRAM NAME";
4020 INPUT Pgm$
4030 ON ERROR GOTO 4060
4040 CREATE BDAT Pgm$&":HP8290X,700,0",10,50
4050 GOTO 4150
4060 IF ERRN=54 THEN 4062
4061 GOTO 4010
4062 DISP "FILE ALREADY EXISTS-WANT TO SHOW(1), REPLACE(2), OR BACK(3)?";
4063 INPUT Ans
4064 ON Ans GOTO 4070,4150,100
4065 GOTO 100
4070 ASSIGN @Pgm TO Pgm$&":HP8290X,700,0"
4080 ENTER @Pgm,1;Dat$,R
4081 PRINT "CREATED ";Dat$
4090 PRINT "REGIONS";TAB(10);"TIME";TAB(20);"A";TAB(30);"B";TAB(40);"C";TAB(50);
"D";TAB(60);"TX"
4100 FOR I=1 TO R STEP 1
4110 ENTER @Pgm,I+1;Aa,Bb,C,D,T,Tx
4120 PRINT TAB(2);I;TAB(11);T;TAB(19);Aa;TAB(29);Bb;TAB(39);C;TAB(49);D;TAB(59);
Tx
4130 NEXT I
4140 ASSIGN @Pgm TO *
4141 GOTO 100
4150 REM  *** START NEW FILE ***
4151 OFF ERROR
4160 OUTPUT 709;"TD"
4161 ENTER 709;Dat$
4170 PRINT "DATE IS ";Dat$
4180 ASSIGN @Pgm TO Pgm$&":HP8290X,700,0"
4190 DISP "HOW MANY REGIONS?";
4191 INPUT R
4200 OUTPUT @Pgm,1;Dat$,R
4210 PRINT "VPS=AT+B   IPS=CT+D   TX=CAPTURE TIME"
4220 FOR I=1 TO R STEP 1
4230 DISP "INPUT VALUES FOR A,B,C,D,T,TX FOR REGION ";I;
4240 INPUT Aa,Bb,C,D,T,Tx
4250 OUTPUT @Pgm,I+1;Aa,Bb,C,D,T,Tx
4260 NEXT I
                                  VPS,
4270 GOTO 100
5000 REM  ***** CALIBRATE     ,IPS AND DACS  ***
5010 DISP "AUTO CALIBRATE~~(1),~~ OR ENTER FROM KEYBOARD(2) ~~:~~ ?"
```

```
5020 INPUT Ans
5030 ON Ans GOTO 5040,5280
5040 DISP "AUTO CALIBRATE VOLTAGE-INSERT INSULATING SLICE--THEN PRESS ENTER";
5041  INPUT Ans$
5042   OUTPUT 709;"A04,0,0 A04,2,0 DC2,1,2,3,4"
5043   OUTPUT 709;"A04,1,2000 A04,0,3000"
5044   WAIT 1
5045   OUTPUT 709;"AC3"
5046   OUTPUT 709;"AF0 AL3 VT3 VN4 AE1"
5047   TRIGGER 709
5048   ENTER 709;Vs1,Vt1,Ic1
5050 !
5080 OUTPUT 709;"A04,0,5000 A04,1,5000"
5081 WAIT 1
5082 OUTPUT 709;"AC3"
5090 OUTPUT 709;"AF0 AL3 VT3 VN4 AE1"
5091 TRIGGER 709
5100 ENTER 709;Vs2,Vt2,Ic2
5110 OUTPUT 709;"A04,0,0 A04,1,0"
5120 OUTPUT 709;"DC2,1,2,3,4"
5130 Calib1=2/(Vt2-Vt1)
5131 Offset1=-1000*Vt1+3000*Calib1
5140 DISP "AUTO CALIB CURRENT-REMOVE INSULATOR--THEN PRESS ENTER";
5141 INPUT Ans$
5142 OUTPUT 709;"DC2,1,2,3,4"
5143 OUTPUT 709;"A04,1,1000 A04,0,5000"
5144 WAIT 1
5145 OUTPUT 709;"AC3"
5146 OUTPUT 709;"AF0 AL3 VT3 VN4 AE1"
5147 TRIGGER 709
5148 ENTER 709;Vs1,Vt1,Ic1
5150 !
5180 OUTPUT 709;"A04,1,2000 A04,0,5000"
5181 WAIT 1
5182 OUTPUT 709;"AC3"
5190 TRIGGER 709
5200 ENTER 709;Vs2,Vt2,Ic2
5210 OUTPUT 709;"A04,0,0 A04,1,0"
5220 OUTPUT 709;"DO2,1,2,3,4"
5230 Calib2=1/(Ic2-Ic1)
5231 Offset2=-1000*Ic1+1000*Calib2
5240 PRINT "CALIBRATE COMPLETE-VALUES ARE"
5250 PRINT "VOLTAGE FACTOR = ";Calib1;"OFFSET = ";Offset1
5260 PRINT "CURRENT FACTOR = ";Calib2;"OFFSET = ";Offset2
5270 GOTO 100
5280 DISP "ENTER VOLTAGE FACTOR ,OFFSET";
5290 INPUT Calib1,Offset1
5300 DISP "ENTER CURRENT FACTOR ;OFFSET";
5310 INPUT Calib2,Offset2
5320 GOTO 100
9000 END
9070 SUB G
9071 PLOTTER IS 3,"INTERNAL"
9080 GCLEAR
9090 SUBEND
9100 SUB Skip
9110 J=J+1
9120 SUBEND
9130 SUB Prt
9140 DISP "WHAT IS PRINTER LOCATION? <716>";
9150 INPUT Ans
9160 PRINTER IS Ans
9170 SUBEND
9180 SUB Err1
9181 COM Er
9190 IF ERRN<>64 THEN 9210
9200 DISP "DISK FULL";
9210 Er=2
9211 OFF ERROR
9220 SUBEXIT
9230 IF ERRN<>54 THEN 9270
9240 DISP "FILE ALREADY EXISTS";
9250 Er=3
9251 OFF ERROR
```

```
9260 SUBEXIT
9270 IF ERRN<>56 THEN 9310
9280 DISP "FILE NOT PRESENT";
9290 Er=4
9291 OFF ERROR
9300 SUBEXIT
9310 Er=5
9311 OFF ERROR
9320 SUBEND
```

APPENDIX B

The following are diagrams of the wiring for the various components discussed hereinabove as follows:

Drawing A shows the wiring and external connections of the ammeter 5 and power supply 3;

Drawing B shows the external connections of the data acquisition unit 1; and

Drawings C and D show the wiring of the plugs of Drawing B.

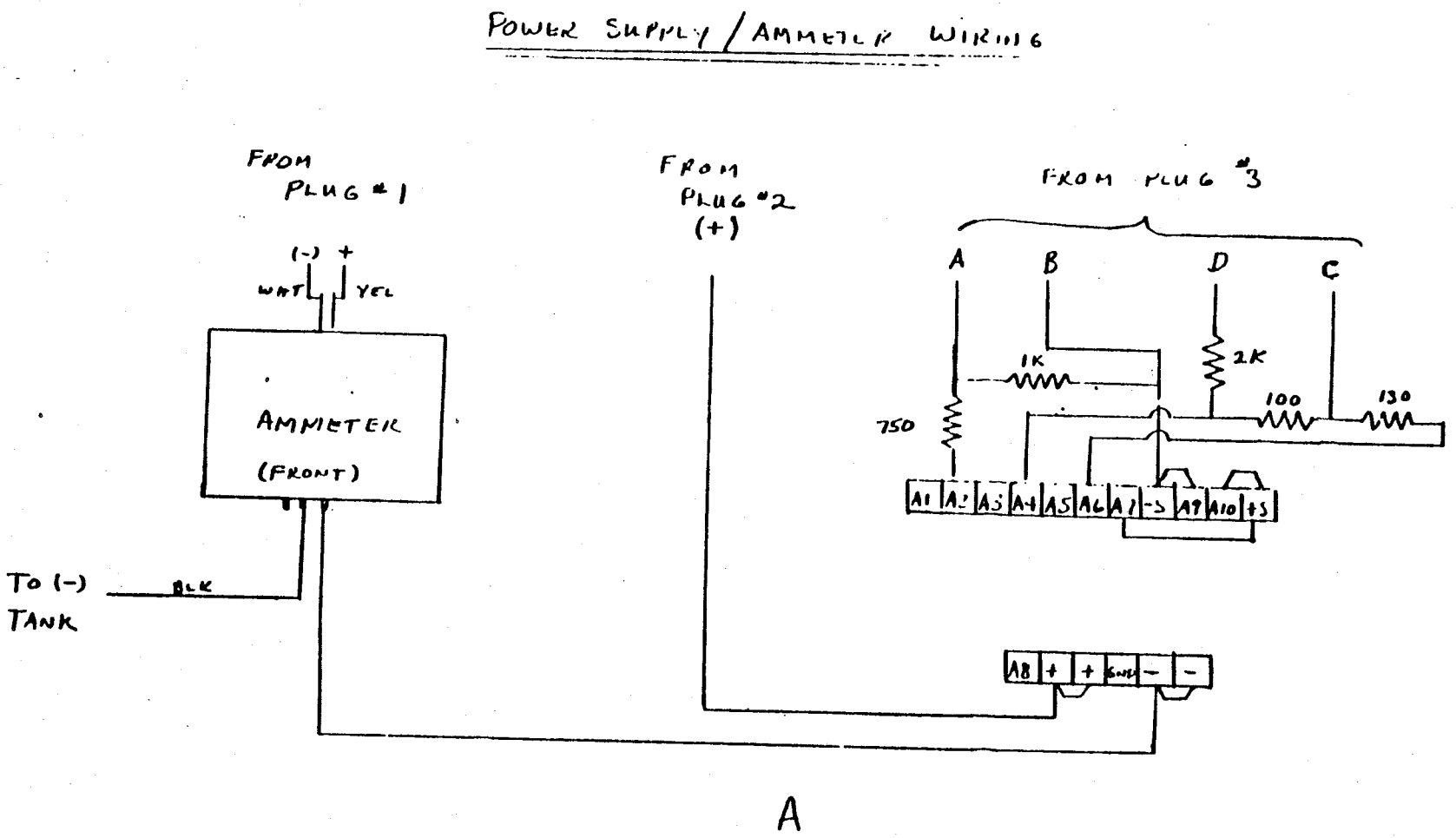
POWER SUPPLY / AMMETER WIRING
FROM PLUG #3
A
B
C
D
750
1K
2K
100
130
A1 A2 A3 A4 A5 A6 A7 A8 A9 A10 A11
FROM PLUG #2 (+)
A8 + + - -
FROM PLUG #1
(-) +
WHT
YEL
AMMETER (FRONT)
BLK
TO (-) TANK
A

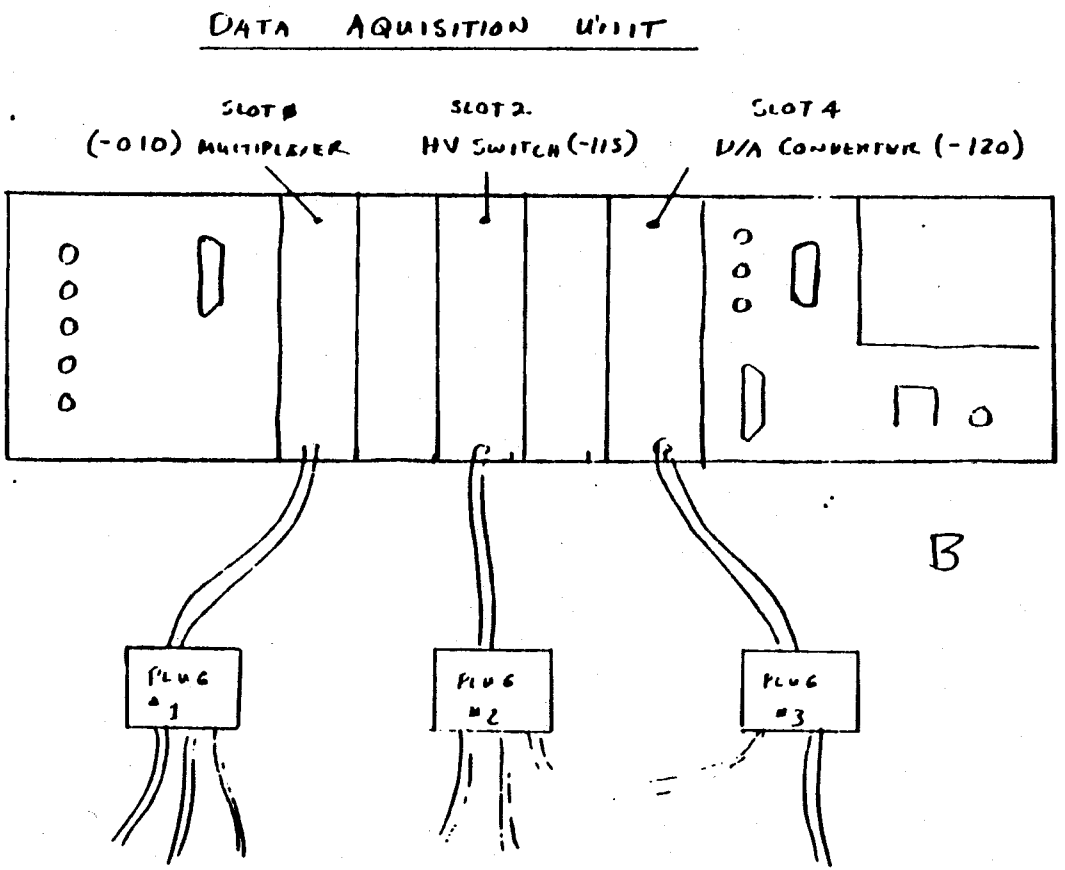
DATA AQUISITION UNIT
SLOT 1
(-010) MULTIPLEXER
SLOT 2.
HV SWITCH (-115)
SLOT 4
D/A CONVERTER (-120)
B
PLUG #1
PLUG #2
PLUG #3

PLUG WIRING
C
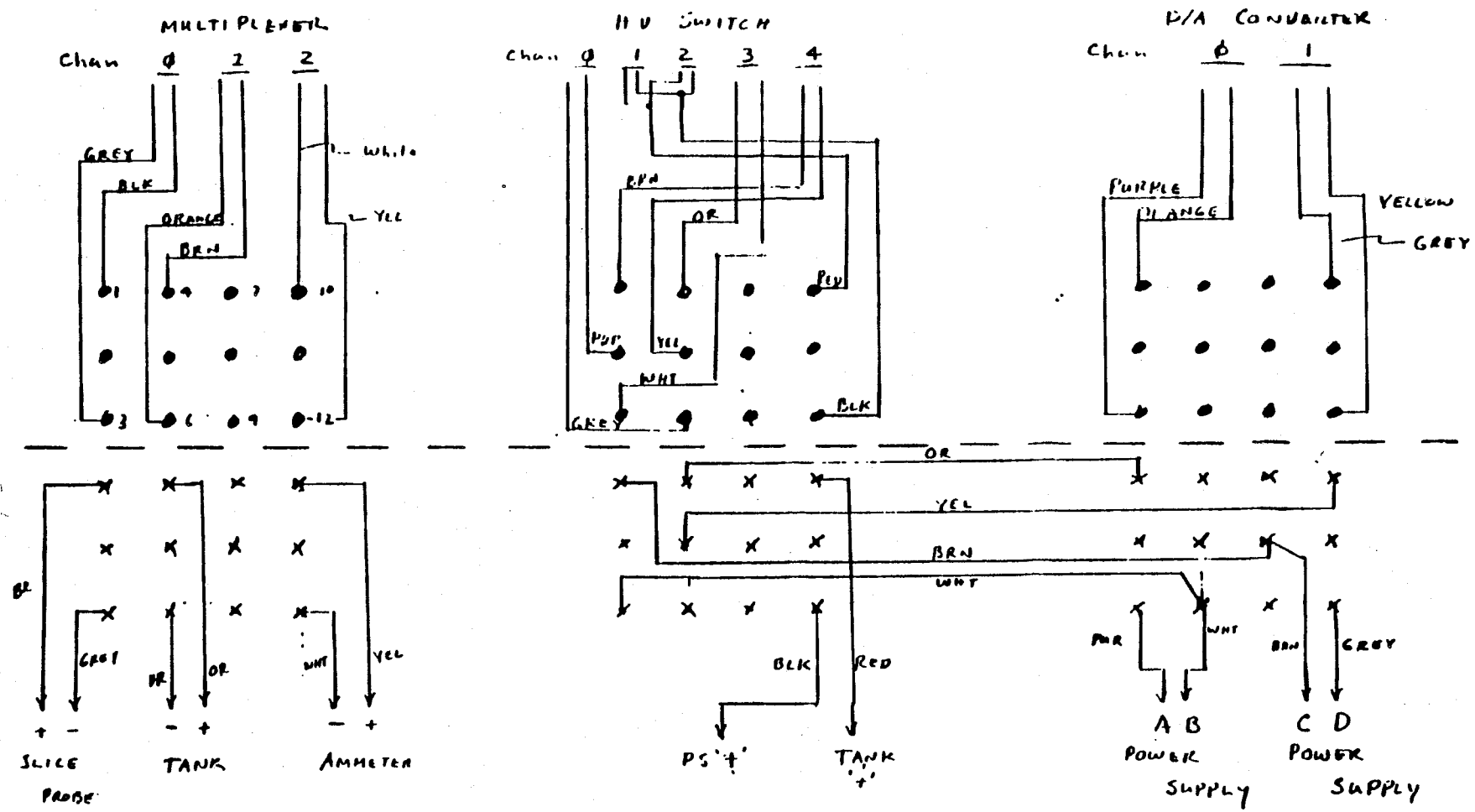
PLUG #1 PLUG #2 PLUG #3

DATA AQUISITION UNIT - PLUG WIRING D

PLUG #1 - HV SWITCH MODULE

| COLOR - PIN (PIN) | WIRING POINT | TO |
|---|---|---|
| GREY - 6 | Chan Ø - FUSE | PUMP 1 RELAY |
| PURPLE - 2 | Chan Ø | PUMP RELAY |
| WHITE - 3 (3) | Chan 3 | DA - 6 (white) |
| ORANGE - 4 (4) | Chan 3 - FUSE | DA - 1 |
| YELLOW - 5 | Chan 4 | DA - 10 |
| BROWN - 1 | Chan 4 - FUSE | DA-2 - 100/130 Ω |
| BLACK - 12 | Chan 1,2 - FUSE | + |
| RED - 16 | Chan 1,2 | ANCHORAGE TANK |

PLUG #2 - MULTIPLEXER MODULE

| COLOR - PIN | WIRING POINT | TO |
|---|---|---|
| BLACK - 1 | $A_0$ - H | SLICE + |
| GREY - 3 | $A_0$ - L | SLICE - |
| BROWN - 4 | $A_1$ - H | TANK + |
| ORANGE - 6 | $A_1$ - L | TANK - |
| WHITE - 10 | $A_2$ - H | AMMETER + |
| YELLOW - 12 | $A_2$ - L | AMMETER |

PLUG #3 - D/A VOLTAGE MODULE

| COLOR - PIN | WIRING POINT | TO |
|---|---|---|
| ORANGE - 1 (1) | Chan Ø - L | HV-4 |
| PURPLE - 3 (3) | Chan Ø - H | 750 - H (Purple) |
| YELLOW - 10 (10) | Chan 1 - L | HV-5 |
| GREY - 12 (12) | Chan 1 - H | 2K |

We claim:

1. A system for anodizing a semiconductor element, comprising:

(a) a tank containing an electrolyte solution therein;

(b) means to provide a flow of electrons through said electrolyte under controlled voltage and current density;

(c) means holding a semiconductor element in said electrolyte in the path of said electrons;

(d) a pair of voltage probes positioned in said electrolyte at locations spaced from and on opposite sides of said element to provide a voltage measurement therebetween; and (e) means responsive to said voltage measurement to control said controllable voltage and current.

2. A system as set forth in claim 1 wherein said means holding a wafer and said wafer form wall dividing said tank into two non-communicating compartments.

3. A system as set forth in claim 2 wherein said electrolyte is hydrofluoric acid having a concentration of from about 10 to about 40 percent.

4. A system as set forth in claim 3 further including means to remove bubbles formed by anodization from the vicinity of said wafer.

5. A system as set forth in claim 4 wherein said means to remove bubbles comprises means to circulate said electrolyte.

6. A system as set forth in claim 2 further including means to remove bubbles formed by anodization from the vicinity of said wafer.

7. A system as set forth in claim 6 wherein said means to remove bubbles comprises means to circulate said electrolyte.

8. A system as set forth in claim 1 wherein said electrolyte is hydrofluoric acid having a concentration of from about 10 to about 40 percent.

9. A system as set forth in claim 8 further including means to remove bubbles formed by anodization from the vicinity of said wafer.

10. A system as set forth in claim 9 wherein said means to remove bubbles comprises means to circulate said electrolyte.

11. A system as set forth in claim 1 further including means to remove bubbles formed by anodization from the vicinity of said wafer.

12. A system as set forth in claim 11 wherein said means to remove bubbles comprises means to circulate said electrolyte.

13. A method for anodizing a semiconductor element, comprising the steps of:

(a) providing a tank containing an electrolyte solution therein;

(b) providing a controlled flow of electrons through said electrolyte under controlled voltage and current density;

(c) holding a semiconductor element in said electrolyte in the path of said electrons;

(d) positioning a pair of voltage probes in said electrolyte at locations spaced from and on opposite sides of said element to provide a voltage measurement therebetween; and (e) controlling said controllable voltage and current in response to said voltage measurement.

14. A method as set forth in claim 13 further including positioning said means holding a wafer and said wafer in said tank to form a wall dividing said tank into two non-communicating compartments.

15. A method as set forth in claim 14 further including the step of removing bubbles formed by anodization from the vicinity of said wafer.

16. A method as set forth in claim 13 further including the step of removing bubbles formed by anodization from the vicinity of said wafer.

* * * * *